US005740572A

United States Patent [19]

Hannant

[11] Patent Number: 5,740,572

[45] Date of Patent: Apr. 21, 1998

[54] PATIENT SUPPORT TABLES WITH ARTICULATED LEG SUPPORT SECTIONS

[75] Inventor: Keith Hannant, Rustington, England

[73] Assignee: Smiths Industries Public Limited Company, London, England

[21] Appl. No.: 824,546

[22] Filed: Mar. 26, 1997

[30] Foreign Application Priority Data

Apr. 12, 1996 [GB] United Kingdom ..... 9607595

[51] Int. Cl.[6] ..... A61G 13/08; A61G 13/00

[52] U.S. Cl. ..... 5/624

[58] Field of Search ..... 5/624, 623, 621, 5/648; 297/423.12, 423.26

[56] References Cited

U.S. PATENT DOCUMENTS 4,336,965 6/1982 Lipp ..... 297/435
4,367,869 1/1983 Dailey et al. ..... 5/624
4,881,728 11/1989 Hunter .

FOREIGN PATENT DOCUMENTS 1556308 12/1967 France .
2 081 083 2/1982 United Kingdom .
2 297 686 8/1996 United Kingdom .

*Primary Examiner*—Alexander Grosz
*Attorney, Agent, or Firm*—Pollock, Vande Sande & Priddy

[57] ABSTRACT

An operating table has two leg sections each of which has a rotatable shaft extending along its length. Each shaft carries a gear that engages another gear fixed with the table such that raising or lowering the leg section causes the shaft to rotate. A helical spring extends helically around each shaft and is arranged to coil up when the leg section is lowered, so that the weight of the section is counterbalanced.

5 Claims, 1 Drawing Sheet

PATIENT SUPPORT TABLES WITH ARTICULATED LEG SUPPORT SECTIONS

BACKGROUND OF THE INVENTION

This invention relates to patient support tables.

The invention is more particularly concerned with tables having an articulated section for supporting a leg.

Operating tables are available with leg sections for supporting the legs. Each leg section is articulated at the hip and the knee so that the section can be put into various different positions. In one form of such a leg section, the upper part of the section, on which the thigh is supported, has a shaft running along its length. The shaft is coupled at its upper end, towards the hip of the patient, with a bevel gear that engages a fixed gear. At its other end, the shaft has a second bevel gear coupled to another gear attached to the upper end of a lower section, on which the calf is supported. Rotating the upper part of the section about the hip joint, to raise the knee, causes the shaft to rotate, which in turn causes the lower part of the section to rotate in the opposite sense, thereby lowering the foot end of the lower part. In this way, the leg section mimics the behaviour of the human leg when this is raised. Some form of lock is provided so that the leg section can be fixed at any desired position.

When the leg section lock is released, it is free to be moved in any direction. The leg section can be heavy, especially when supporting the weight of the patient's leg. In GB 2297686 there is described a ratchet arrangement for preventing the leg section falling, if it were to be released inadvertently during manoeuvring. The weight of the leg section combined with the weight of the leg and any associated equipment supported on the section can, however, still make manipulation difficult.

BRIEF SUMMARY OF THE INVENTION

It is an object of the present invention to provide an improved patient support table.

According to one aspect of the present invention there is provided a patient support table of the kind having an articulated limb section connected to the table, the limb section having a rotatable shaft extending along its length, the shaft being coupled via a gear at one end of the shaft to a cooperating gear such that raising or lowering the limb section causes the shaft to rotate, the shaft having associated therewith energy-storage means arranged such that energy is stored in the energy-storage means by rotation of the shaft caused by the lowering of the limb section to counteract at least in part the weight of the limb section.

The energy storage means preferably includes resilient means, such as a helical spring, which may extend helically about the shaft, energy being stored by coiling of the spring. The limb section is preferably a leg section.

A surgical operating table with two articulated leg sections, in accordance with the present invention, will now be described, by way of example, with reference to the accompanying drawing.

DETAILED DESCRIPTION OF THE PREFERRED EMBODIMENT

Figure 1:
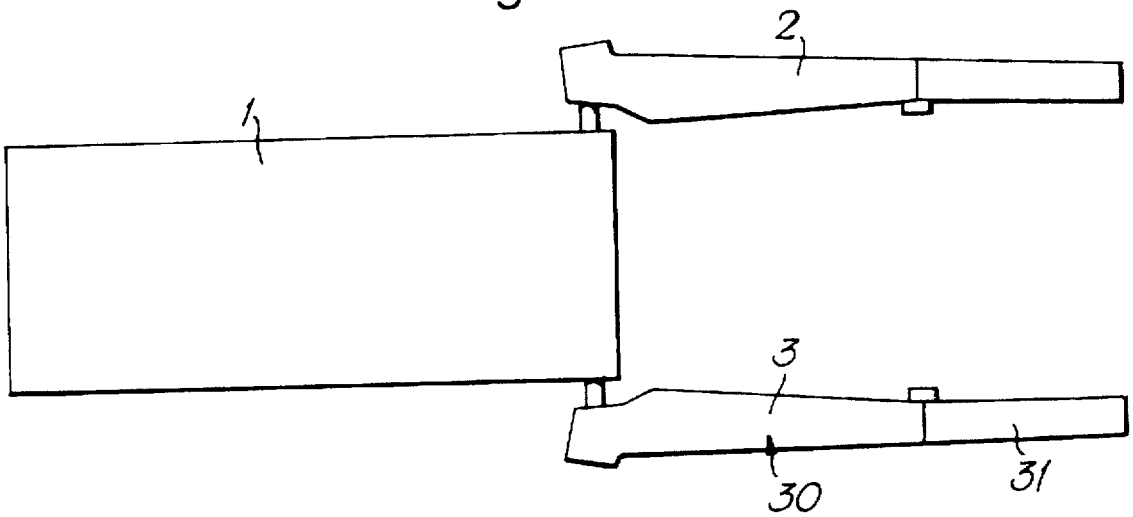
FIG. 1 is a plan view of the table.

With reference to FIG. 1, the operating table includes a generally rectangular support section 1 mounted at the upper end of a vertical support column (not shown) in the usual way. The rectangular section 1 is adapted to support the head and torso of the patient. The table also has two, narrower leg support sections 2 and 3 mounted at the right-hand, hip end of the torso section 1.

Figure 2:
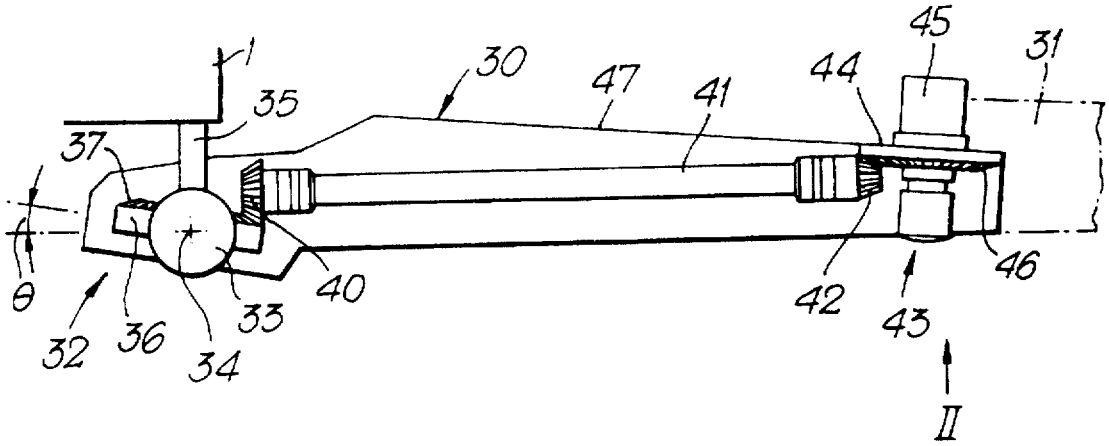
FIG. 2 is a cut-away simplified plan view showing one of the leg sections.
Figure 3:
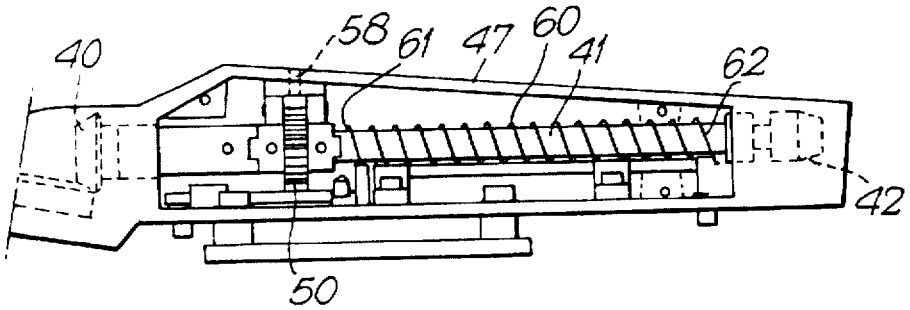
FIG. 3 is a sectional plan view showing the leg section in more detail.

With reference now also to FIGS. 2 and 3, the leg sections 2 and 3 are of similar construction, so only the right-leg section 3 will be described. The section 3 has two parts or leaves 30 and 31 arranged to support the thigh and calf respectively. The first, thigh leaf 30 is coupled to the main support section 1 at one end by a joint 32. The joint 32 comprises a ball 33 about which the thigh leaf 30 is rotatable. The ball 33 is fixed at one end of a short arm 35 projecting horizontally from the end of the main support section 1. A bevel gear ring 36 encompasses the ball 33 and is oriented in a vertical plane. The bevel gear ring 36 has a pin that engages a track (not shown) extending horizontally around the ball 33 by about 90°, so that the gear ring can be rotated through about 90° but only about a vertical axis. The gear ring 36 has teeth around its inner face 37 that mesh with teeth around a second bevel gear 40, which forms a part of the joint 32. The second bevel gear 40 is fixed at the left end of a rotatable lay shaft 41 extending axially along the thigh leaf 30 within its outer housing 47. A third bevel gear 42 at the opposite end of the shaft 41 rotates with the shaft. The third bevel gear 42 forms a part of a joint 43 between the thigh leaf 30 and the calf leaf 31 located in the region of the patient's knee. The joint 43 is completed by a fourth bevel gear 44 fixed to a short, horizontal stud shaft 45. The fourth bevel gear 44 lies in a vertical plane and has teeth on its outwardly-facing side 46 meshing with teeth around the third bevel gear 42.

Towards its left-hand, hip end, the shaft 41 has a ratchet wheel 50 (FIG. 3) fixed with it so that the ratchet wheel rotates with the shaft. A catch or pawl lever (not shown) engages the wheel 50 and prevents lowering of the leg section 3 unless the catch is held released manually. Further details of this ratchet mechanism are given in GB 2297686. A helical torsion spring 60 extends co-axially around the lay shaft 41 to the right of the ratchet wheel 50. The spring 60 is attached to the shaft 41 at one end 61 and, at its other end 62, is fixed with the housing 47. The spring 60 is arranged such that it is substantially relaxed when the leg section 3 is fully elevated, so that lowering of the leg section coils and tightens the spring against its resilience.

The calf leaf 31 is fixed at its left-hand end to the stud shaft 45 to extend radially from the shaft, so that it is rotated with the shaft about its axis.

In use, the two leg sections 2 and 3 can be brought together or abducted by rotating them about the vertical axis 34 through each joint 32 in the region of the hip of the patient. A lock, not shown, is used to clamp the thigh leaf 30 to the ball 33 and prevent further movement about the vertical axis 34 once the desired angle in the horizontal plane has been set. With the thigh leaf 30 horizontal, the calf leaf 31 also extends horizontal, so that the leg section 2 or 3 is flat and straight. The leg sections 2 and 3 can be elevated about the joint 32 by lifting the knee end of the thigh leaf 30. As the section 2 or 3 is raised, the second bevel gear 40 rotates around the gear ring 36, thereby rotating the lay shaft 41 in an anticlockwise sense, when viewed from the foot end, and uncoiling the spring 60. This rotation of the shaft 41 is permitted by the ratchet and pawl mechanism 50, without any need to actuate the release catch. As the shaft 41 rotates, it also rotates the third bevel gear 42 at the knee end of the shaft. This, in turn, causes the fourth bevel gear 44 to rotate and hence causes the shaft 45 to rotate in a clockwise sense when viewed along the arrow II of FIG. 2. Rotation of the shaft 45 rotates the calf leaf 31 with it, to lower the foot end of the leaf with respect to the knee end. Thus, as the leg section 2 or 3 is lifted, it bends at the knee joint 43 in a way that mimics the natural flexing of the human leg.

When the leg section 2 or 3 is lowered, its spring 60 coils and tightens, acting as an energy storage device. The force required to tighten the spring 60 counteracts the weight of the leg section 2 or 3, the resilience of the spring being selected such that it balances the unloaded weight of the leg section. When the leg section 2 or 3 is raised, the stored energy in the spring 60 is released to assist the raising of the section. The spring rating of the spring 60 is such that the spring tension does not decrease significantly when it uncoils, as the leg section is raised. Similarly, the increase in tension caused by lowering the leg section is not significant and is easily overcome because of the weight of the leg. The resilience of the spring need not necessarily completely balance the unloaded weight of the leg section, providing that it counteracts the weight of the leg section, at least in part.

The arrangement of the present invention considerably facilitates manipulation of the leg section when loaded, since the user only has to move the weight of the leg and not the combined weight of the leg and the leg section.

There are various other forms of energy storage means that could be associated with the shaft to counteract the weight of the leg section, such as, for example, hydraulic or pneumatic means.

What I claim is:

1. A patient support table comprising: an articulated limb section (2,3), said limb section having a rotatable shaft (41) extending along its length, said shaft having a first gear (40) at one end of the shaft; a main section (1) of the table, said main section (1) having a second gear (36), said second gear engaging with said first gear (40) such that raising or lowering said limb section (2,3) causes said shaft (41) to rotate; and an energy-storage device (60) connected with said shaft such that, when said limb section is lowered, said shaft (41) is rotated and energy is stored in the energy-storage device (60) to counteract at least in part the weight of said limb section (2, 3).

2. A patient support table according to claim 1, wherein said energy-storage device is a resilient device (60).

3. A patient support table according to claim 2, wherein said resilient device is a helical spring (60).

4. A patient support table according to claim 3, wherein said helical spring (60) extends helically about said shaft (41), and wherein energy is stored by coiling of said spring (60).

5. A patient support table comprising: two articulated leg sections (2, 3) each said leg section having a rotatable shaft (41) extending along its length, and each said shaft (41) having a first gear (40) at one end; a main section (1) of the table (2), said main section having two further gears (36), said further gears (36) engaging with respective ones of said first gears (40) such that raising or lowering either leg section (2, 3) causes the respective shaft (41) to rotate; and a helical spring (60) extending around each said shaft such that, when said either leg section (2, 3) is lowered, said shaft (41) is rotated and the spring (60) is coiled to counteract at least in part the weight of said leg section.

* * * * *